US007776290B2

(12) United States Patent
Michalsky et al.

(10) Patent No.: US 7,776,290 B2
(45) Date of Patent: Aug. 17, 2010

(54) CONTAINER FOR A MULTI-COMPONENT REACTION

(75) Inventors: Andreas Michalsky, Memmingerberg (DE); Raphael Cholodewicz, Kempten (DE)

(73) Assignee: Huhtamaki Ronsberg Zweigniederlassung der Huhtamaki Deutschland GmbH & Co. KG, Ronsberg-Allgäu (DE)

( * ) Notice: Subject to any disclaimer, the term of this patent is extended or adjusted under 35 U.S.C. 154(b) by 687 days.

(21) Appl. No.: 11/628,570

(22) PCT Filed: Apr. 14, 2005

(86) PCT No.: PCT/EP2005/003963

§ 371 (c)(1),
(2), (4) Date: Mar. 29, 2007

(87) PCT Pub. No.: WO2005/118426

PCT Pub. Date: Dec. 15, 2005

(65) Prior Publication Data

US 2007/0217971 A1 Sep. 20, 2007

(30) Foreign Application Priority Data

Jun. 4, 2004 (DE) ..... 10 2004 027 322
Jan. 5, 2005 (DE) ..... 10 2005 000 832

(51) Int. Cl.
*B01J 7/02* (2006.01)
*B01J 19/00* (2006.01)
*B65D 23/08* (2006.01)
*B65B 1/20* (2006.01)

(52) U.S. Cl. ..... 422/236; 422/224; 206/219; 141/11

(58) Field of Classification Search ..... 422/224, 422/236; 141/11; 206/219
See application file for complete search history.

(56) References Cited

U.S. PATENT DOCUMENTS 2,874,830 A * 2/1959 Birmingham, Jr. ..... 206/221
2,898,744 A 8/1959 Robbins
3,608,709 A 9/1971 Pike
3,683,889 A 8/1972 Hoffman
4,462,224 A 7/1984 Dunshee et al.
4,534,509 A * 8/1985 Holzner ..... 239/34

(Continued)

FOREIGN PATENT DOCUMENTS

DE 2 852 642 8/1980

(Continued)

OTHER PUBLICATIONS

Machine translation of WO 01/46037 A1, which was published on Jun. 28, 2001.*

*Primary Examiner*—Walter D Griffin
*Assistant Examiner*—Natasha Young
(74) *Attorney, Agent, or Firm*—Husch Blackwell Sanders Welsh & Katz

(57) ABSTRACT

The invention relates to a container (10) for a multi-component reaction, having at least two chemical chambers (20) and at least one mixing space, the container (10) being formed from a base film (40) provided with recesses (30) and an upper film (50), which is optionally structured, the upper film (50) being joined, especially sealed, to the base film (40), at least over sections. The invention relates also to a method of filling such a container.

3 Claims, 3 Drawing Sheets

U.S. PATENT DOCUMENTS

| | | | | |
|---|---|---|---|---|
| 2003/0116452 | A1 | 6/2003 | Saric et al. | |
| 2003/0213708 | A1 | 11/2003 | Crevier et al. | |
| 2004/0050437 | A1 * | 3/2004 | Engel et al. | 137/843 |
| 2006/0118434 | A1 * | 6/2006 | Leiner et al. | 206/219 |

FOREIGN PATENT DOCUMENTS

| | | | |
|---|---|---|---|
| DE | 3717512 | | 12/1987 |
| DE | 90 00 813 | | 3/1990 |
| DE | 9312427 | | 10/1993 |
| EP | 0 378 183 | | 7/1990 |
| GB | 20 33 566 | | 5/1980 |
| JP | 11 227843 | | 8/1999 |
| WO | WO 95/05327 | | 2/1995 |
| WO | WO 00/09415 | | 2/2000 |
| WO | WO 00/61455 | | 10/2000 |
| WO | WO 01/46037 | A1 * | 6/2001 |
| WO | WO 2004/0283890 | A2 * | 4/2004 |

* cited by examiner

CONTAINER FOR A MULTI-COMPONENT REACTION

The invention relates to a container for a multi-component reaction and to a method of filling such a container in accordance with the preambles of patent claims 1 and 22.

Containers for multi-component reactions are known and are used, for example, in so-called pocket warmers or light sticks. Such containers generally comprise at least two chemical chambers which are broken open in use so that reaction components contained therein are able to interact with one another. As a result of that interaction—generally a chemical or physical reaction—heat is either supplied to or removed from the environment. A further result of such an interaction can also be the generation of light or sound.

In accordance with one variant, when the chambers are broken open the container itself is opened to the extent that either the reaction components individually or the reaction product produced therefrom can be discharged for a further use. This is the case, for example, with multi-component adhesives.

The afore-mentioned pocket warmers or light sticks are a further variant in which the container having the reaction components remains undamaged externally, even after the chemical chambers have been broken open.

The production of such containers and the filling thereof is effected in accordance with the prior art by finishing the container in its entirety to the point where filling of the chemical chambers can be effected from a side seam that is left open and later sealed, the reaction component in question being introduced into the respective tubular chamber of the container provided therefor. The sealing seam is then closed. The container per se is formed by two planar films or like planar bodies, which, at least over sections, are sealed to one another.

That procedure suffers from several disadvantages, some of which are serious. Firstly, it is extremely difficult in practice to achieve uniform, homogeneous filling of the chambers by pouring the reaction component into the respective container chamber, especially when the reaction component is in the form of a paste, powder or solid, which results in poor distribution ability. That in turn results in an uneven course of the reaction during later interaction of the reaction components and the associated possibility of excessively intense local heating or cooling of the container, but in any case results in inefficient utilisation and usefulness of the container. Furthermore, that filling process is very time-consuming.

Moreover, that filling method also has an effect on the geometry of the container, which is of irregular structure because the substances introduced inevitably create a bulge on the lower side of the container, whereas the reaction chambers remain as it were empty on their upper filling side even after being filled.

A further disadvantage of that filling variant is that filling has to take place transversely across the region of a future sealing seam, there being a risk that the regions that are later to be sealed will become soiled by the solid or fluid reaction component being introduced into the respective chambers, which, without an additional cleaning step with its associated risk of contamination of the reaction components, results in a weakened and potentially leaky sealing seam.

The problem of the invention is to avoid the above-mentioned disadvantages and to provide a container for a multi-component reaction, having at least two chemical chambers and at least one mixing space, that allows homogeneous and equally distributed filling of the reaction components into the chemical chambers without risk of soiling the regions that are later to be sealed or closed, the container itself providing a uniform and secure standing surface. A further problem of the invention relates to the filling of such a container.

That problem is solved by a container according to patent claim 1 and by a method according to patent claim 22.

In particular, the problem is solved by a container for a multi-component reaction having at least two chemical chambers and at least one mixing space, the container being formed from a base film provided with recesses and an upper film, which is optionally structured, the upper film being joined, especially sealed, to the base film, at least over sections.

An important aspect of the invention is that the base film is provided with recesses into each of which a desired reaction component can easily be introduced. Because the base film extends horizontally, the recesses are substantially bath-shaped and/or beaker-shaped and extend in turn substantially perpendicularly to the base surface. In the absence of the optionally structured upper film, the recesses are therefore freely accessible from above for a filling operation, so that the filling operation can be performed as a horizontal process.

By virtue of such free accessibility, troublefree homogeneous and equally distributed introduction of the respective reaction components, whether in solid, paste or fluid form, is possible.

The upper film is joined to the base film at least over sections, sealing or adhesive bonding of the two films being a preferred joining method. Sealing is carried out in such a way that the recesses provided in the base film, which form the chemical chambers, are separated from one another so that premature intermixing of the reaction components arranged in the chemical chambers is not possible. Such intermixing can take place only when the seal separating the chambers from one another is broken open and a mixing space for the reaction components is thus made available.

The reaction components can be brought into contact with one another also by means of valves arranged between the chemical chambers, which valves are optionally closable again. This is advantageous, for example, when, in the case of a heat-generating reaction, heating that is uniform and long-lasting over a period of time is to be effected, without undesired sudden increases in temperature. In other words, by means of a valve-like passageway from chamber to chamber it is possible to control the reaction and, if desired, also to terminate the reaction.

According to the invention, at least the base film is impressed and/or deep-drawn and/or folded in order thus to create the recesses in the base film. It will be understood that the upper film can be of analogous construction. That is advantageous especially when the structuring of the upper film corresponds to the structuring of the base film and when the multi-component reaction taking place in the container is associated with an increase in volume.

Both the upper film and the base film can be produced from a plastics film, preferably a cold-deformable plastics film, and/or such a laminate, preference being given to a high-strength plastics or aluminium laminate. Furthermore, the upper film preferably comprises a material of high thermal conductivity, such as, for example, a metal, preferably aluminium. In that way, in the case of an exothermic or endothermic reaction, good transfer of heat between the interior of the container and the environment is possible, so that the container is usable as a heating or cooling container. Depending upon the field of use, the base film can also be provided with a corresponding material of high thermal conductivity.

It should be mentioned at this point that the material of high thermal conductivity can be embedded in a laminate or, for example, can also be present solely as a metal film per se.

In accordance with a preferred embodiment, the base film is produced from a foamed material and comprises especially polyethylene and/or polypropylene and/or polyethylene terephthalate and/or mixtures thereof. That is advantageous when the base film is to act as an insulating lower film, while on the upper side of the container a drink or a meal, for example, is to be heated or kept warm. In that case, the base film serves to avoid loss of heat downwards, whereas the upper film, which is produced from a material of high thermal conductivity, serves to deliver the heat as effectively as possible to the article placed on the container.

For that purpose, in accordance with an advantageous embodiment the base film has a metallic, preferably reflective layer, especially in the form of a metal coating. According to the invention, such a layer is applied to the inner side of the base film, that is to say to the side of the base film that faces the interior of the container, and preferably consists of aluminium. That can be applied to the base film or to the laminate forming the base film by vapour-deposition or in the form of a film.

Where it is desirable for the transfer of heat to be as effective as possible, such a metal coating can be applied both to the inner side and to the outer side of the films forming the container.

Furthermore, in accordance with one embodiment of the invention the base film and/or the upper film have at least one barrier layer that comprises ethyl vinyl alcohol (EVOH), quartz ($SiO_2$) and/or aluminium, especially in the form of a film or a deposited layer.

As a result of such a barrier layer, the container according to the invention becomes impermeable in respect of permeation and/or diffusion of substances into or out of the container.

Furthermore, the container can be selectively permeable to certain substances, if that is desirable. Such selective permeation is advantageous, for example, when pressure equalisation with the environment is to be achieved, in order to prevent the container from bursting or bulging.

The individual chambers of the container are separated from one another by means of strip sealing and/or by means of spot sealing and/or as a result of an applied reduced pressure, especially a vacuum, which brings about sealing contact of base film and upper film one against the other. The mentioned seals can be in the form of weakened seals having predetermined breaking sites in order in that way to ensure connection of the individual chemical chambers to one another to define a mixing space, destruction of the container caused by breaking open of an outer sealing seam being avoided.

According to the invention, at least one chamber has a predetermined breaking site, especially in the form of an internal seal that comes to a point, so that starting from that chamber, on application of pressure, a mixing space is formed which is formed from the space of at least one adjacent chamber and the chamber having the internal point. The mixing space in turn forms a reaction chamber in which the reaction of the reaction components takes place.

When a container chamber is acted upon by a reduced pressure or a vacuum, opening the predetermined breaking site or the internal seal that comes to a point has the effect that a reaction component present in an adjacent chamber with or without a relatively low reduced pressure suddenly spreads into the evacuated chamber and initiates a very rapid, possibly explosion-like consequent reaction. Furthermore, spreading and intermixing of reaction components is advantageously assisted by the intake of components from adjacent chambers initiated by reduced pressure, which contributes to a rapid and complete reaction.

In accordance with a further embodiment of the invention, there is provided at least one operable opening device or aid, which can be, for example, in the form of a spike or blade in order to create a connection between adjacent chambers so that a mixing space is formed. The opening device is advantageously secured against unintentional operation, so that the production of an undesired fluid connection between the chambers in question is avoided. By means of the operable opening device it is possible to pierce the sealing seams between the base film and the upper film separating the chambers, the base film and the upper film being forced apart and the seal being broken. Care should be taken that the base film or upper film is on no account pierced when the seal is separated. For that purpose, in the region of the opening site or aid, a portion of greater strength can be provided by means of which damage to the base film and upper film is avoided. A planar, for example spatulate, configuration of the opening device, corresponding to the configuration of the sealing seams, is likewise helpful.

For rapid and homogeneous uniting of the reaction components there is provided, furthermore, a duct system in the form of channels, ribs and/or a distributor body, which is preferably structured, especially perforated, along which the reaction components are able to spread and distribute themselves. Such a duct system can be produced, for example, by applying a vacuum to the container, starting from a chamber which preferably contains a fluid medium, during the sealing of the container, so that the air is extracted from the container. On so doing, folds are formed, especially in the upper film, the inner sides of which folds, as a result of the vacuum, lie closely and sealingly one against the other, but which folds are able to be separated from one another when a chamber is broken open and act as a channel-like distributor system.

Such fold formation during the application of a vacuum is desirable in accordance with one aspect of the invention and can be assisted, for example, by selecting the dimensions of the upper film to be somewhat greater than is absolutely necessary for covering the base film.

A further possible way of providing a channel-like duct system lies in making a deliberate choice in the construction of weakened sealing seams which break open preferentially. Such sealing seams can, for example, be of thinner construction or be less strongly sealed than adjacent strong sealing seams.

Otherwise, it is also possible for fixed ribs or channels to be incorporated into the container according to the invention, along which a fluid or paste-form reaction component is distributed. Furthermore, a film-like distributor body can be provided which, in the form of a film or tube, forms a connection between the reaction chambers. In accordance with a film-form configuration, such as distributor film body can be perforated and arranged above the reaction chambers. A fluid reaction component, which again is provided above the distributor film body and is released to initiate the multi-component reaction, is accordingly distributed quickly and uniformly above the distributor film body and, passing through the perforations in the distributor film body, makes contact with further reaction components provided in the chambers of the container according to the invention. In accordance with a further embodiment, it is possible to guide a fluid reaction component through a tubular distributing system to the chambers in question which contain further reaction components.

In accordance with a further embodiment of the invention, the container, as mentioned above, has at least one pressure-relief device to prevent the container from bursting or bulging. The pressure-relief device preferably comprises at least one region that is separated from the mixing space, preferably by a sealing seam. That region can be in the form of separate, sealed-off corners. In the event of excess pressure in the interior of the container, which would lead to bursting or bulging, pressure equalisation can take place by means of that pressure-relief device, with a sealing seam between a mixing space and the separated-off region being opened initially in a first step. The opening can be brought about by a sealing seam of defined thickness and optionally with the aid of an internal seal that comes to a point, the opening pressure which effects the seal coming from the interior of the container containing the reaction components.

It is also possible for the pressure-relief device to have a throttle and/or a labyrinth for controlled pressure equalisation, which can be combined with a filter device which prevents fluid and/or vapour and/or reaction components or products from escaping from the container.

Furthermore, the separated region or the separately sealed-off corners can have recesses in the form of depressions which are provided for receiving fluid or reaction components. As filter medium there can be provided, for example, a fibrous mat, a sponge or some other textile and/or porous planar body inside the separated-off region.

Depending upon the size of the container according to the invention or in accordance with the level of the reaction enthalpy, it is also possible, if necessary, for a plurality of pressure-relief devices to be present on the container according to the invention.

The multi-component reaction can take place either exothermically with heat being lost or alternatively endothermically with heat being absorbed. In the former case, according to the invention the container serves for heating substances, while in the latter case it is able to act as a cooling unit which serves for cooling articles or substances.

For achieving an exothermic reaction, glycerol and potassium permanganate, for example, are provided as reaction components. Those reaction components are, as already mentioned, introduced into the chemical chambers in a substantially horizontal position of the base film, the upper film not yet having been applied to the base film. In that way, the chemical chambers are readily accessible from above, so that homogeneous and uniform distribution of the solid and crystalline potassium permanganate in the chemical chambers is possible. Preferably, the container according to the invention has five chemical chambers for that purpose, with solid potassium permanganate being located in four of the chemical chambers, while the fifth chemical chamber contains fluid glycerol. Pressure applied to the chemical chamber containing the glycerol causes a sealing seam to open, so that the glycerol flows into the adjacent reaction chamber filled with potassium permanganate, where it enters into a redox reaction with the potassium permanganate.

The problem according to the invention is also solved by a method according to patent claim 22. In particular, the problem is solved by a method of filling a container in accordance with the description above, the method being characterized by the following steps:

providing a base film having recesses, filling the recesses with reaction components in a substantially horizontal position of the base film, closing the container by joining, especially sealing, the base film to an upper film, at least over sections.

Further embodiments of the invention will be found in the subsidiary claims.

The invention is described below on the basis of an exemplary embodiment which is explained in greater detail with reference to the Figures.

In the description which follows, parts that are the same or have the same action have been given the same reference numerals.

Figure 1:
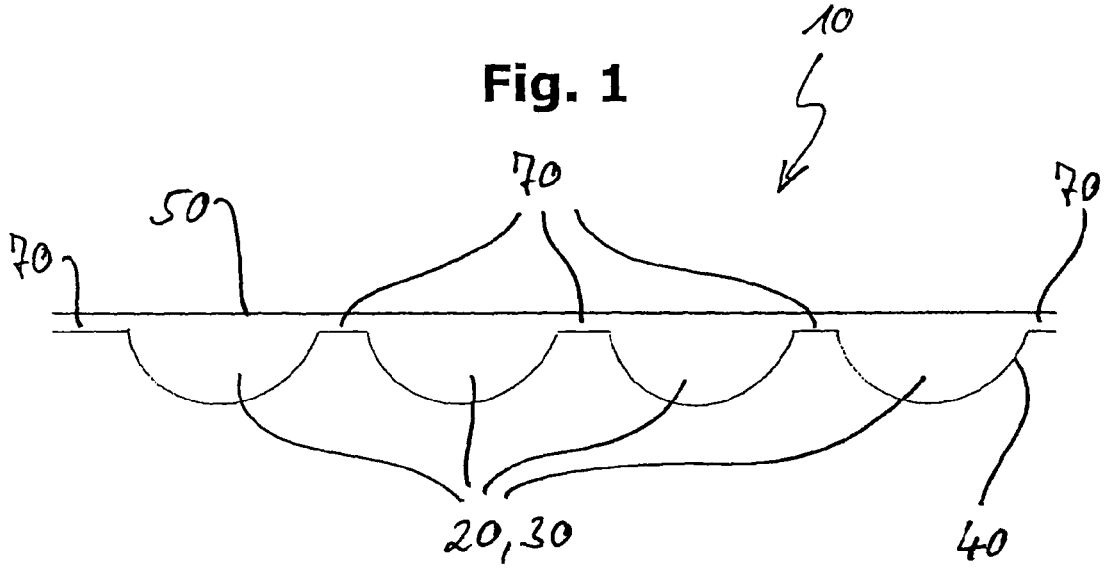
FIG. 1 is a diagrammatic view of an embodiment of a container according to the invention in cross-section.

FIG. 1 shows a diagrammatic cross-sectional view of an embodiment of a container 10 according to the invention having four chemical chambers 20. The chemical chambers 20 are in the form of recesses 30 in a base film 40. The base film 40 is joined to an upper film 50 at sealing regions 70. When the individual chemical chambers 20 are broken open, a mixing space is formed, inside which the reaction components arranged in the chemical chambers 20 become intermixed and interact with one another.

Figure 2:
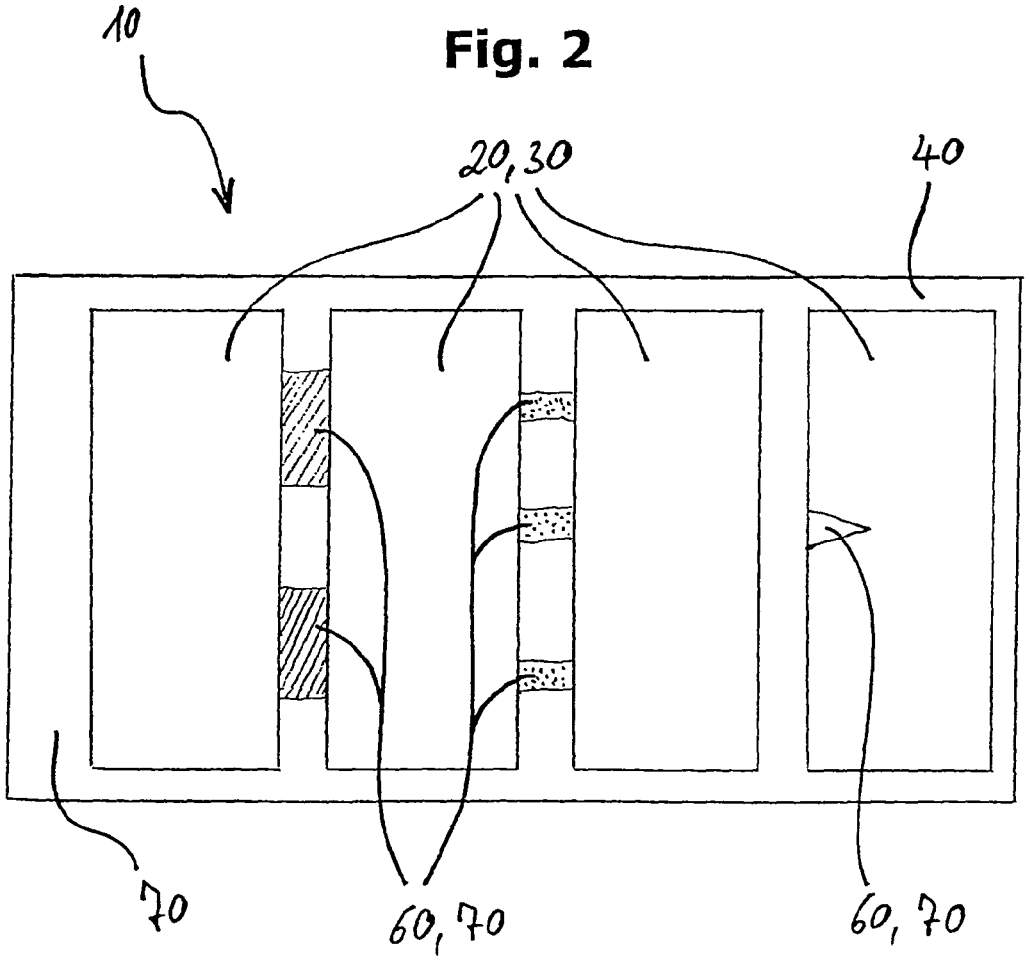
FIG. 2 is a diagrammatic view of the embodiment according to FIG. 1 in plan view.

FIG. 2 shows a container according to the invention in accordance with the embodiment from FIG. 1 in plan view, the upper film 50 being shown as transparent for reasons of clarity. In the base film 40, which is arranged below the upper film 50 (not shown), there are four reaction chambers 20 in the form of recesses 30 in which the reaction components (not shown) are arranged. Potassium permanganate is homogeneously distributed in the three left-hand chemical chambers 20, while the right-hand chemical chamber 20 contains glycerol.

The (transparent) upper film 50 is arranged on the base film 40 and joined to the base film 40 along sealing regions 70. Inside the sealing regions, reference numeral 60 indicates a number of predetermined breaking sites which have a weaker seal than the normal sealing regions. The three dotted regions indicate spot-sealing which allows a certain amount of communication between the respective adjacent chambers. In this instance, such communication does not present problems even when the chambers are not broken open, because solid potassium permanganate is present in both chambers. The hatched sealing regions, by means of which the two left-hand chambers can be connected to one another, take the form of a seal having strip-shaped sealing portions and not a seal over the entire area. In that respect, the sealing in the two left-hand strip sealing regions 60 is weaker than that in the sealing region 70 which is an outer closure of the container and seals off the interior of the container from the exterior of the container.

Otherwise, in the right-hand chemical chamber 20 there is a provided a seal that comes to point 60 which constitutes a predetermined breaking site 60. On application of pressure to the glycerol-containing right-hand chemical chamber, the predetermined breaking site 60 breaks at the seal that comes to a point and glycerol flows into the adjacent chamber 20 containing potassium permanganate, from where, with the application of pressure, the breaking open of further chambers continues. The container according to this embodiment serves as a heating plate for articles to be heated and is distinguished by excellent stability both in respect of an uneven substrate and in respect of an article mounted on the upper film 50. The base film 40 is formed from foamed polypropylene, so that the base film forms an insulating lower film which is coated on its inner side with aluminium. The upper film 50 is in the form of an optionally bi-directionally stretched polyethylene terephthalate film coated on both sides with an aluminium film.

Figure 3:
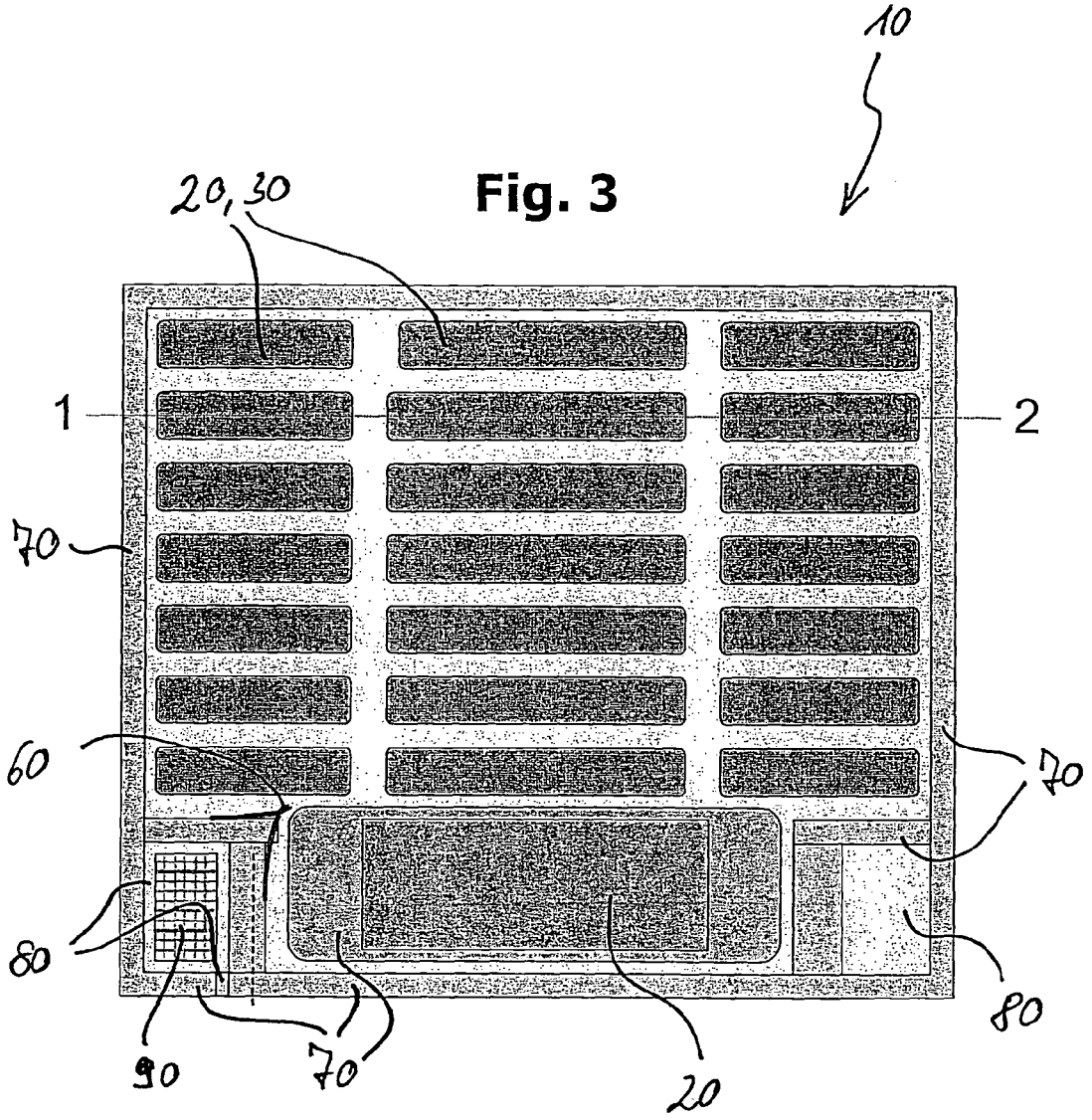
FIG. 3 is a diagrammatic view of a further embodiment of a container according to the invention in plan view.

FIG. 3 shows a diagrammatic view of a further embodiment of a container according to the invention in plan view, which has pressure-relief devices 80 at the corners. The pressure-relief devices 80 at the corners are separated from the mixing space of the container 10 by sealing regions 70. The sealing regions 70, by means of which the pressure-relief devices 80 are sealed, have as predetermined breaking site 60 a seal that comes to a point facing towards the mixing space. Inside a separated-off region of a pressure-relief device 80 there is arranged a fibrous mat 90 which serves as filter medium and prevents fluid or vapour from escaping from the container 10.

Figure 4:
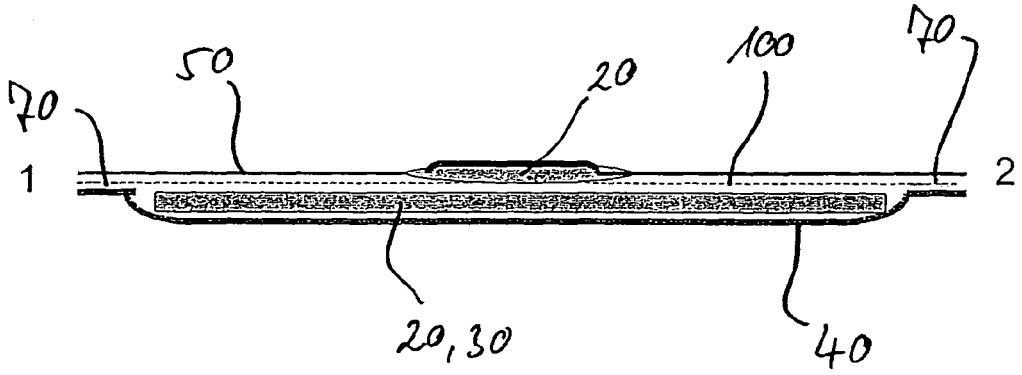
FIG. 4 is a diagrammatic view of a variant of the embodiment according to FIGS. 3 and 5 in cross-section along line 1-2.

FIG. 4 shows a cross-sectional view of a variant of the embodiment according to the invention shown in FIG. 3 along section line 1-2 shown in FIG. 3. As will be seen, above a chemical chamber 20, which is in the form of a recess 30, there is a perforated film body 100 by means of which a further chemical chamber 20, which is arranged above the perforated film body 100, is accessible. When the upper chemical chamber 20 is broken open, the fluid located therein spreads unimpeded within the container 10 above the perforated film body and passes through the perforations of the perforated film body 100 into the chemical chambers 20 in the base film 40 located underneath. By virtue of the unimpeded spreading of the fluid above the perforated film body and the defined perforation of the film body 100, the reaction of the two reaction components can be exactly controlled. The chemical chamber 20 of the container 10 located at the top in FIG. 4 is not shown in FIG. 3 for reasons of clarity.

Figure 5:
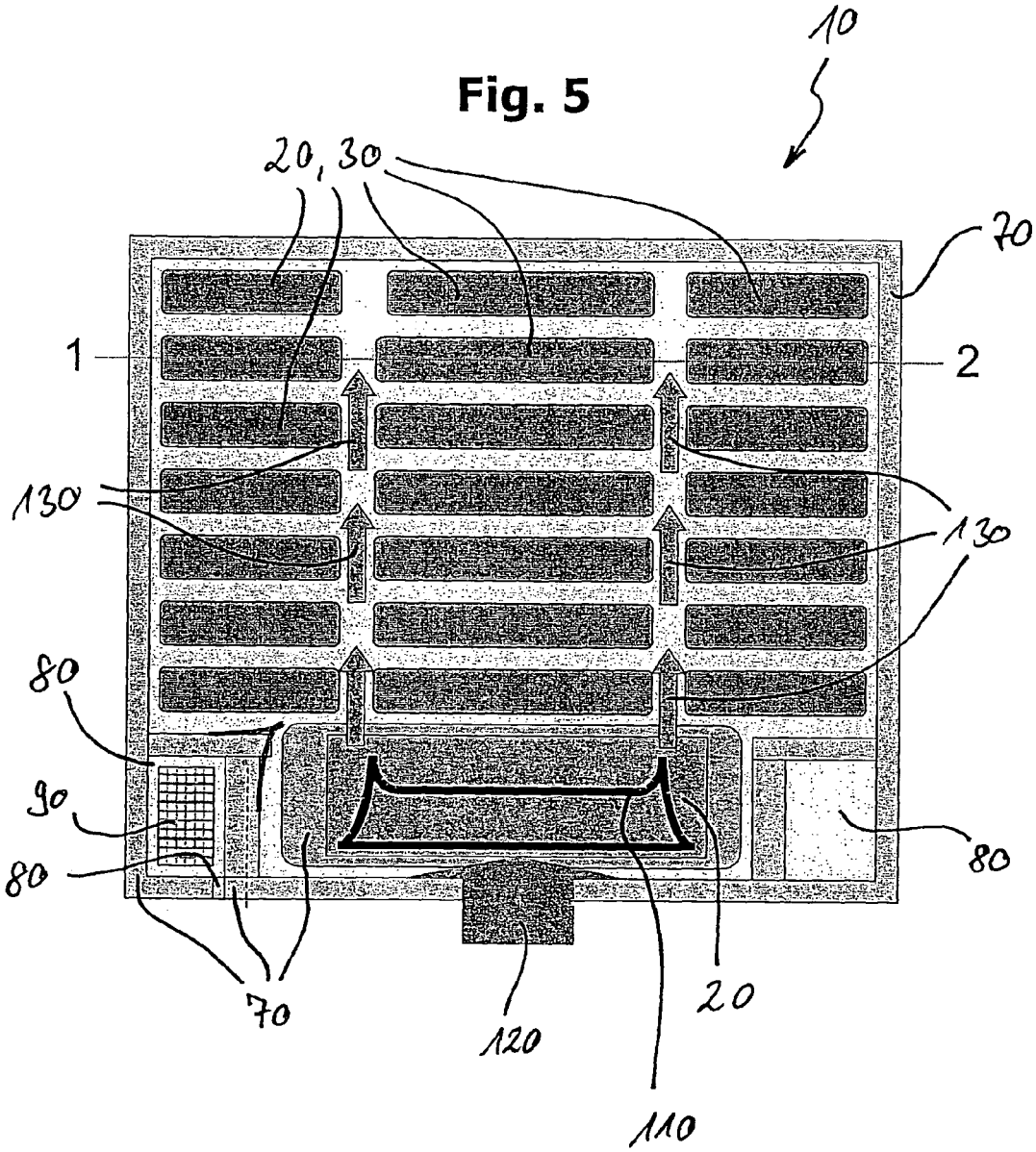
FIG. 5 is a diagrammatic view of a further embodiment of a container according to the invention having an opening device.

FIG. 5 shows an embodiment of a container 10 that is protected against undesired bursting or bulging in accordance with a further embodiment in which an opening device or opening aid 110 is provided for creating a mixing space, which is operated in the direction of arrow 120 and results in the spreading of fluid in accordance with the arrows 130. The opening device 110 is used to pierce a seal 70 by means of which separation of the chemical chambers 20, 30, which are formed in the base film 40, and the chemical chamber 20, inside which the opening device 110 is located, is effected.

It should be pointed out here that all the above-described parts, alone and in any combination, especially the details shown in the drawings, are claimed as being important to the invention. Modifications thereof will be known to the person skilled in the art.

LIST OF REFERENCE NUMERALS

10 container
20 chemical chamber
30 recesses
40 base film
50 upper film
60 predetermined breaking site
70 sealing region
80 pressure-relief device
90 fibrous mat
100 perforated film body
110 opening device/aid
120 operating direction arrows
130 spreading of fluid

The invention claimed is:

1. A container for a multi-component reaction, the container comprising: at least two chemical chambers and at least one mixing space, said container being formed form a base film provided with recesses and an upper film joined to said base film, at least over sections; wherein a duct system selected from the group consisting of channels, ribs, a distributor film body, a structured distributor film body, a perforated distributor film body, and a mixture of two or more of said duct systems is provided for rapid and homogeneous uniting of reaction components; and wherein at least one reaction component or fluid reaction component, is arranged above the distributor film body.

2. A container for a multi-component reaction, the container comprising at least two chemical chambers and at least one mixing space, said container being formed from a base film provided with recesses and an upper film joined to said base film, at least over sections;

wherein the container has at least one pressure-relief device to prevent bulging of the container; and wherein the pressure-relief device has a control device selected from the group consisting of a throttle, a labyrinth, and a throttle and a labyrinth for controlled pressure equalization.

3. A container for a multi-component reaction, the container comprising at least two chemical chambers and at least one mixing space, said container being formed from a base film provided with recesses and an upper film joined to said base film, at least over sections;

wherein the container has at least one pressure-relief device to prevent bulging of the container; and wherein the said pressure-relief device includes a device selected from the group consisting of a filter device, a fibrous mat filter device, a labyrinth filter device, a fibrous mat and labyrinth filter device, a filter device in combination with at least one recess, a fibrous mat filter device in combination with at least one recess, a labyrinth filter device in combination with at least one recess, and a fibrous mat and labyrinth filter device in combination with at least one recess, to prevent fluid and/or vapor, such as reaction components, from escaping.

* * * * *